US012790551B2

(12) United States Patent
Haverly et al.

(10) Patent No.: US 12,790,551 B2
(45) Date of Patent: Nov. 10, 2026

(54) METHOD FOR THE REMOVAL OF CHLORINE FROM FATS, OILS AND GREASES

(71) Applicant: Renewable Energy Group, Inc., Ames, IA (US)

(72) Inventors: Martin Haverly, Ames, IA (US); Ramin Abhari, Bixby, OK (US); David A. Slade, Ames, IA (US); Jared Brown, Ankeny, IA (US)

(73) Assignee: Renewable Energy Group, Inc., Ames, IA (US)

( * ) Notice: Subject to any disclaimer, the term of this patent is extended or adjusted under 35 U.S.C. 154(b) by 507 days.

(21) Appl. No.: 18/332,285

(22) Filed: Jun. 9, 2023

(65) Prior Publication Data

US 2024/0124785 A1 Apr. 18, 2024

Related U.S. Application Data

(60) Provisional application No. 63/350,751, filed on Jun. 9, 2022.

(51) Int. Cl.

| | |
|---|---|
| ***C10G 31/06*** | (2006.01) |
| ***C10G 3/00*** | (2006.01) |
| ***C10G 31/08*** | (2006.01) |

(52) U.S. Cl.

CPC ..... *C10G 3/60* (2013.01); *C10G 3/50* (2013.01); *C10G 2300/202* (2013.01); *C10G 2300/4006* (2013.01)

(58) Field of Classification Search

CPC ..... C10G 3/50; C10G 3/60; C10G 2300/202; C10G 2300/4006; C10G 31/06;

(Continued)

(56) References Cited

U.S. PATENT DOCUMENTS

| | | | |
|---|---|---|---|
| 5,231,201 | A | 7/1993 | Welsh et al. |
| 5,298,639 | A | 3/1994 | Toeneboehn et al. |

(Continued)

FOREIGN PATENT DOCUMENTS

| | | | |
|---|---|---|---|
| CN | 104974789 | A | 10/2015 |
| EP | 2716746 | A1 | 4/2014 |

(Continued)

OTHER PUBLICATIONS

International Search Report and Written Opinion for PCT/US2023/024951 dated Nov. 8, 2023.

(Continued)

*Primary Examiner* — In Suk C Bullock
*Assistant Examiner* — Jason Y Chong
(74) *Attorney, Agent, or Firm* — Nyemaster Goode, P.C.

(57) ABSTRACT

An improved method for removal of contaminants from low-value and waste fats and oils for the purpose of hydrodeoxygenation into diesel boiling range hydrocarbons. The method includes removing organically bound contaminants from fats, oils, and greases (FOG) by adding water to a contaminated FOG stream, subjecting the mixture to heat, and mixing to promote reaction between the water and the FOG. Then, separating a reacted FOG from the contaminants. The reacted FOG will result in reduced organically bound chlorine contaminants.

18 Claims, 6 Drawing Sheets

(58) Field of Classification Search
CPC ..... C10G 31/08; B01D 11/0446; B01D 11/0488; B01D 11/0492; B01D 17/047
See application file for complete search history.

(56) References Cited

U.S. PATENT DOCUMENTS

| | | | |
|---|---|---|---|
| 7,179,491 | B1 | 2/2007 | Mag |
| 8,394,975 | B2 | 3/2013 | Ortiz Niembro et al. |
| 10,071,322 | B2 | 9/2018 | Coppola et al. |
| 11,466,230 | B1 * | 10/2022 | Li ..... C11B 3/06 |
| 2018/0134987 | A1 | 5/2018 | Fedor et al. |
| 2019/0338200 | A1 | 11/2019 | Slade et al. |
| 2020/0056116 | A1 | 2/2020 | Bruse |
| 2022/0033731 | A1 | 2/2022 | Abhari et al. |
| 2022/0049167 | A1 | 2/2022 | Coppola et al. |
| 2025/0005522 | A1 | 1/2025 | Sossin et al. |

FOREIGN PATENT DOCUMENTS

| | | | |
|---|---|---|---|
| JP | 2009019175 | A | 1/2009 |
| WO | 2014209469 | A1 | 12/2014 |
| WO | 2021118334 | A1 | 6/2021 |

OTHER PUBLICATIONS

Ward, P. M. L. Journal of Food Protection, 2012, 75 (4); 731-737.
Extended European Search Report for Application No. 23820483.8 dated May 19, 2026.
Lakshmanan Shyam et al "Chloride reduction by water washing of crude palm oil to assist in 3-monochloropropane-1, 2 diol ester (3-MCPDE) mitigation", Food Additives & Contaminants: Part A, vol. 38, No. 3, Feb. 17, 2021 (Feb. 17, 2021), pp. 371-387.

* cited by examiner

METHOD FOR THE REMOVAL OF CHLORINE FROM FATS, OILS AND GREASES

CROSS-REFERENCE TO RELATED APPLICATION

The present application claims priority from U.S. Provisional Application No. 63/350,751 filed Jun. 9, 2022, which is incorporated by herein by reference in its entirety.

FIELD OF THE INVENTION

The present technology relates to biofuels, and more particularly, to biomass-based diesel fuels. Specifically, the present invention relates to an improved process for removal of contaminants from low-value and waste fats and oils for the purpose of hydrodeoxygenation into diesel boiling range hydrocarbons.

BACKGROUND OF THE INVENTION

Renewable hydrocarbons are of increasing importance in the global economy as a way of reducing the carbon intensity of hydrocarbon products, such as fuels. The most prevalent renewable hydrocarbon product in use today is renewable diesel. However, additional renewable hydrocarbons, such as renewable naphtha, sustainable aviation fuel, renewable propane, and others are also of critical importance. Hydrodeoxygenation (HDO) of lipids is a critical step in the production of renewable hydrocarbons. Lipid feedstocks of commercial interest include byproducts of ethanol production, animal rendering, and food processing industries such as distiller's corn oil, inedible animal fats, and used cooking oils, respectively. These feeds are characterized by high free fatty acid (FFA) content, typically above 5 wt. %, and relatively high levels of metal and phosphorus (typically above 20 wppm total), and alkalinity values above 200 mg/kg. Certain lipid feedstocks also contain elevated levels of chlorine, typically above 5 wppm.

Chlorine can be present in lipid in both water-soluble (WS) and water-insoluble (WIS) forms. WS chlorine is generally in the form of chlorinated glycerol (i.e., monochloropropanediols), chloride salts (e.g., sodium chloride, potassium chloride), sodium hypochlorite (i.e., bleach), hydrochloric acid, and other chlorinated polar molecules. These impurities can be readily removed from a lipid feedstock using conventional lipid pretreatment steps such as water-washing and therefore do not pose a significant material concern for renewable fuel production. WIS chlorine, on the other hand, is not readily removed from a lipid feedstock using conventional pretreatment steps. WIS chlorine is primarily present in lipids in the form of fatty acid esters of monochloropropanediols (MCPD) isomers 2-MCPD and 3-MCPD, or chlorinated fatty acids (CFA). Molecular structures of typical 2-MCPD and CFA compounds are shown in FIG. 1 and FIG. 2, respectively. MCPD can be in the form of chlorinated monoglycerides or chlorinated diglycerides, and has been reported as the most common occurrence of chlorinated vegetable oils. CFA can be in the form of free fatty acids, monoglycerides, diglycerides, triglycerides, or fatty acid alkyl esters. Chlorinated wax esters and sphingolipids have also been reported in the literature, though these are less common. It is also possible for WIS chlorine to be present in lipids due to the introduction of chlorinated hydrocarbons that are used as cleaning agents, thermal fluids, or other industrial additives. Analysis of commercially sourced brown grease has shown presence of chloroethane, chloroform, chloromethane, 1,2-dichloroethylenes, tetrachloroethylene and trichloroethylene at ppm levels (Ward, P. M. L. *Journal of Food Protection,* 2012, 75 (4); 731-737).

The current methods of lipid pretreatment include degumming/acid treatment, physical and chemical refining (including modified caustic refining wherein the oil is treated with a silica adsorbent as described in U.S. Pat. Nos. 5,231,201 and 5,298,639), and bleaching (described in U.S. Pat. Nos. 7,179,491 and 8,394,975). Reduction in 3-MCPD content of a lipid is cited in US Patent Publication 2020/0056116; however the method comprises refining and bleaching followed by deodorization, whereby treated oil yields are reduced through stripping of FFA and lighter oil fractions. In general, the prior art pretreatment methods do not achieve chlorine reduction levels for optimum HDO reactor performance. Moreover, existing methods of lipid pretreatment have almost no impact on WIS chlorine, and are only capable of moderate reductions in WS chlorine species. Chlorine poses a unique challenge to the production of renewable hydrocarbons as the HDO process converts WIS chlorine to hydrochloric acid, which is a prominent corrosion concern for common materials of construction. In particular, austenitic stainless steels (such as 300-series 304 and 316) are highly susceptible to chloride stress corrosion cracking due to exposure to chlorides that leads to cracking in localized areas of high stress in the metal and is a significant mechanical integrity concern for high-pressure components. Therefore, there is a substantial need for technologies capable of reducing the concentrations of chlorides, and WS chlorides, in particular, for the production of renewable hydrocarbons through hydrotreating lipids.

There are existing methods for removal of common impurities such as phosphorus, iron, sodium, potassium, calcium, and magnesium. These and other common impurities are typically removed through a combination of processes such as water washing, acidulation, adsorbent filtration, absorbent filtration, degumming, or any combination of two or more of these steps.

Existing methods also teach hydrolysis as an effective means of increasing the FFA content of a lipid feedstock. This process, often referred to as fat splitting, is traditionally used for the purposes of producing a purified fatty acid and/or purified glycerol stream. Exemplary methods for hydrolyzing lipid feedstocks include enzymatic hydrolysis, catalytic hydrolysis using catalysts such as zinc-oxide, the Twitchell process, and the Colgate-Emery process. The Colgate-Emery process uses a counter-current liquid-liquid contactor to react clean lipids with water at approximately 490° F. to achieve greater than 90% hydrolysis of the feedstock. It is the most widely used commercial hydrolysis process. Despite being a relatively well-understood process, the prior art is silent on the use and application of hydrolysis for the removal of chlorine and other impurities from waste lipid feedstocks for the production of renewable hydrocarbons.

In U.S. Pat. No. 10,071,322B2, Coppola et al. describe a "hydrothermal clean-up" or "HCU" process for the rapid, complete hydrolysis of lipid feedstocks at temperatures higher than utilized in the Colgate-Emery process, such as 300-500° C. versus 250-260° C., respectively. Coppola et al. teach that complete hydrolysis of the lipid feedstock results in a clean oil with low inorganic impurities such as phosphorus, potassium, sodium, silicon, iron, magnesium, barium, calcium, copper, magnesium, and zinc. Similar to other prior art, the HCU process promotes complete hydrolysis, which is described as being near theoretical maximums, or about 100% complete conversion, of bound fatty acids to free fatty acids. Furthermore, despite the HCU process being described as capable of removing inorganic impurities, Coppola et al. is silent on the impact of the HCU process on removal of chlorine from chlorine-contaminated lipid feedstocks.

The cited prior art by Coppola et al. teaches that contaminant removal is achieved at near complete hydrolysis. However, complete hydrolysis of fatty acid glycerides is generally not advantageous for renewable fuels production via HDO. The removal of the bound glycerol from the fatty acid glycerides translates to loss of propane coproduct. Furthermore, certain unique corrosion concerns emerge during processing of very high FFA feedstock.

There thus remains an unmet need for a lipid feedstock pretreatment process that is capable of removing chlorine from lipid feedstocks for the production of renewable hydrocarbons. Furthermore, there is a need for a hydrolysis-based pretreatment method for HDO reactors that achieves high contaminant removal without significant loss of bound glycerol from fatty acid glycerides.

SUMMARY OF THE INVENTION

One aspect of the invention relates to methods for removing organically bound contaminants from fats, oils, and greases (FOG). The methods includes the steps of adding water to a contaminated FOG stream and subjecting the mixture to heat and mixing to promote reaction between the water and FOG and subsequently separating a reacted FOG from the removed contaminants. As such, the reacted FOG will result in reduced organically bound chlorine contaminants.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
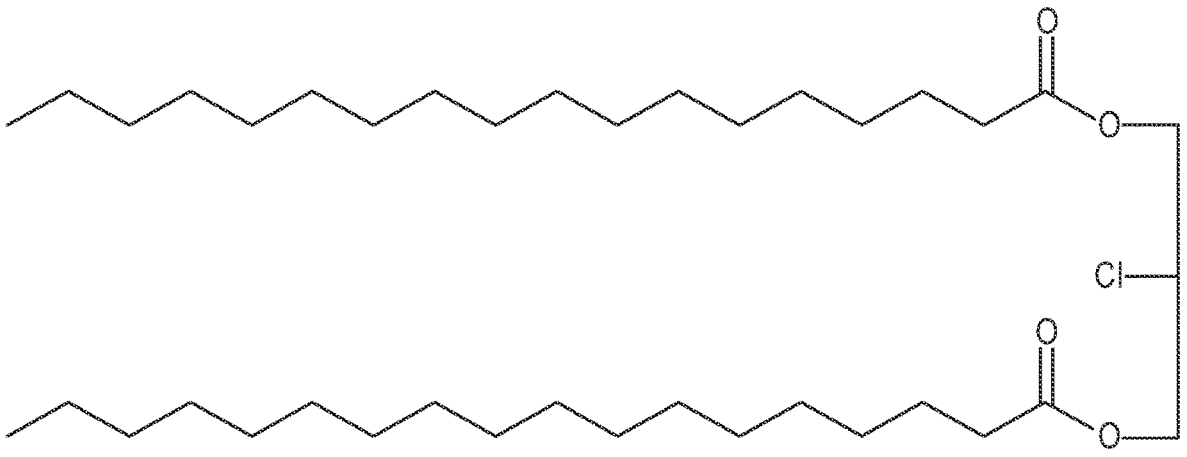
FIG. 1 is a structural drawing of a stearic acid diester of monochloropropanediol.
Figure 2:
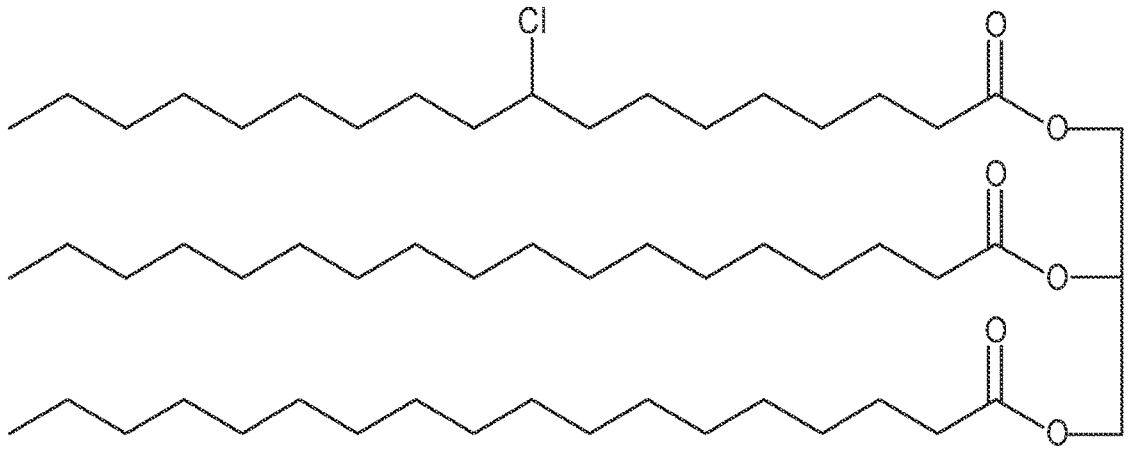
FIG. 2 is a structural drawing of a fatty acid glyceride ester with a chlorinated stearic acid.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

As used herein, "about" will mean up to plus or minus 10% of the particular term. The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

Hydroprocessing as used herein describes the various types of catalytic reactions that occur in the presence of hydrogen without limitation. Examples of the most common hydroprocessing reactions include, but are not limited to, hydrogenation, hydrodesulfurization (HDS), hydrodenitrogenation (HDN), hydrotreating (HT), hydrocracking (HC), aromatic saturation or hydrodearomatization (HDA), hydrodeoxygenation (HDO), decarboxylation (DCO), hydroisomerization (HI), hydrodewaxing (HDW), hydrodemetallization (HDM), decarbonylation, methanation, and reforming. Depending upon the type of catalyst, reactor configuration, reactor conditions, and feedstock composition, multiple reactions can take place that range from purely thermal (i.e., do not require catalyst) to catalytic. In the case of describing the main function of a particular hydroprocessing unit, for example an HDO reaction system, it is understood that the HDO reaction is merely one of the predominant reactions that are taking place and that other reactions may also take place.

Hydrotreating (HT) involves the removal of elements from groups IIIa, Va, VIa, and/or VIIa of the Periodic Table from organic compounds. Hydrotreating may also include hydrodemetallization (HDM) reactions. Hydrotreating thus involves removal of heteroatoms such as oxygen, nitrogen, sulfur, and combinations of any two more thereof through hydroprocessing. For example, hydrodeoxygenation (HDO) is understood to mean removal of oxygen by a catalytic hydroprocessing reaction to produce water as a by-product; similarly, hydrodesulfurization (HDS) and hydrodenitrogenation (HDN) describes the respective removal of the indicated elements through hydroprocessing. Hydroprocessing is also understood to include the removal of covalently bound chlorine to produce hydrochloric acid as a byproduct.

Water insoluble (WIS) chlorine is defined as chlorine that is present in a lipid feedstock and does not wash out when contacted with water at ambient conditions (i.e., room temperature). Without being bound to any particular theory, WIS chlorine is assumed to be a chlorine moiety that is covalently bound to a lipid or hydrocarbon, and is most prevalent as one of either chlorinated fatty acids or chlorinated glycerides.

Water soluble (WS) chlorine is defined as chlorine that is present in a lipid feedstock and readily washes out when contacted with water at ambient conditions (i.e., room temperature). WS chlorine is assumed to be primarily one of either chlorinated glycerol (i.e., monochloropropandiols), chloride salts (e.g., sodium chloride, potassium chloride), sodium hypochlorite (i.e., bleach), hydrochloric acid, or other chlorinated polar molecules. It will be understood that if a composition is stated to include "$C_i$-$C_j$ hydrocarbons," such as $C_7$-$C_{12}$ n-paraffins, this means the composition includes one or more paraffins with a carbon number falling in the range from i to j.

A "middle distillate" in general refers to a petroleum fraction in the range of about 200° F. (93° C.) to about 800° F. (427° C.). This includes kerosene (about 200-520° F.), diesel and light gasoil (about 400 to 650° F.), and heavy gasoil (about 610-800° F.).

A "lipid" as used herein refers to fats, oils, and greases. Lipids are comprised of saturated and unsaturated fatty acids in the $C_8$-$C_{24}$ range, wherein the fatty acids can be in the form of esters of glycerin (i.e. as mono-, di-, and triglycerides), or as free fatty acids (FFA).

The term "monochloropropanediol" or "MCPD" is defined as a chlorinated glycerol molecule wherein one oxygen moiety has been replaced with a chlorine moiety. The chlorine moiety may exist at the 1, 2, or 3 position. The term monochloropropanediol or MCPD, as used herein, can also be understood to refer to both the chlorinated glycerol moiety bound to fatty acids through ester bonds or a chlorinated glycerol that exists as a free alcohol.

The term "bound glycerol" is defined as glycerol which is bound to fatty acids through ester bonds, such as found in mono-, di-, and tri-glycerides. The term bound glycerol, as used herein, can also be understood to include monochloropropanediols bound to fatty acids.

The term "free glycerol" is defined as glycerol which exists as a free alcohol and is not bound to any fatty acids through ester bonds. The term bound glycerol, as used herein, can also be understood to include MCPDs. Glycerides or total glycerides is the sum of monoglycerides, diglycerides, and triglycerides. Total glyceride content is a measure of bound glycerol in the lipid, and glyceride conversion is a measure of glycerol liberated through conversion of glycerides to FFA via hydrolysis.

It is to be understood that a "volume percent" or "vol. %" of a component in a composition or a volume ratio of different components in a composition is determined at room temperature (about 23° C.) based on the initial volume of each individual component, not the final volume of combined components.

One aspect of the present invention relates to a method for producing a pretreated lipid feedstock with total chlorine and WIS chlorine concentrations that are less than the starting or unconditioned total chlorine and WIS chlorine concentrations. Table 1 provides typical total chlorine and WIS chlorine contents for various unconditioned waste lipid feedstock.

In one respect, a method is provided to produce a preconditioned lipid feedstock with both WIS chlorine and phosphorus concentrations that are less than the starting or unconditioned WS chlorine and phosphorus concentrations. Table 1 provides typical WIS chlorine and phosphorus contents for various unconditioned waste lipid feedstock.

TABLE 1

Representative total chlorine, water-soluble (WIS) chlorine, and phosphorus values for crude waste lipid feedstocks*.

| Lipid Feedstock Type | Total Chlorine (wppm) | WIS Chlorine (wppm) | Phosphorus (wppm) |
|---|---|---|---|
| UCO #1 | 21 | 14 | 12 |
| UCO #2 | 49 | 24 | 5 |
| UCO #3 | 350 | 95 | 22 |
| BFT | 6 | 3 | 59 |
| CWG | 8 | 4 | 133 |
| DCO | 4 | 3 | 6 |
| YG | 9 | 7 | 59 |

*Used Cooking Oil (UCO), Bleachable Fancy Tallow (BFT), Choice White Grease (CWG), Distillers Corn Oil (DCO), and Yellow Grease (YG)

The method comprises the steps of initially contacting a waste lipid feedstock stream with a water stream and then subjecting the combined stream to sufficient temperature and mixing to produce a chlorine-diminished lipid stream and a chlorine-enriched heavy phase. In some embodiments, an acid catalyst is added to the mixture to facilitate conversion of WIS chlorine to WS chlorine. In some embodiments, the pretreated lipid feedstock is greater than the FFA concentration of the un-pretreated lipid feedstock.

Exemplary lipid feedstocks include, but are not limited to, an animal fat, animal oil, microbial oil, plant fat, plant oil, vegetable fat, vegetable oil, grease, or a mixture of any two or more thereof. Plant and/or vegetable oils and/or microbial oils include, but are not limited to, corn oil, inedible corn oil, babassu oil, *carinata* oil, soybean oil, canola oil, coconut oil, rapeseed oil, tall oil, tall oil fatty acid, palm oil, palm oil fatty acid distillate, jatropha oil, palm kernel oil, sunflower oil, castor oil, camelina oil, archaeal oil, bacterial oil, fungal oil, protozoal oil, algal oil, seaweed oil, oils from halophiles, and mixtures of any two or more thereof. These may be classified as crude, degummed, and RBD (refined, bleached, and deodorized) grade, depending on level of pretreatment and residual phosphorus and metals content. However, any of these grades may be used in the present technology. Animal fats and/or oils as used above includes, but is not limited to, inedible tallow, edible tallow, technical tallow, floatation tallow, lard, poultry fat, poultry oils, fish fat, fish oils, and mixtures of any two or more thereof. Greases may include, but are not limited to, yellow grease, brown grease, waste vegetable oils, restaurant greases, trap grease from municipalities such as water treatment facilities, and spent oils from industrial packaged food operations, and mixtures of any two or more thereof.

Depending on level of pretreatment, such biorenewable lipid feedstock may contain between about 1 wppm and about 800 wppm phosphorus, and between about 1 wppm and about 400 wppm total metals (mainly sodium, potassium, magnesium, calcium, iron, and copper). The lipid may also contain up to about 40 wt. % free fatty acid. The FFA content of the lipid may be about 1 wt. %, about 2 wt. %, about 3 wt. %, about 4 w. t %, about 5 wt. %, about 6 wt. %, about 7 wt. %, about 8 wt. %, about 9 wt. %, about 10 wt. %, about 11 wt. %, about 12 wt. %, about 13 wt. %, about 14 wt. %, about 15 wt. %, about 16 wt. %, about 17 wt. %, about 18 wt. %, about 19 wt. %, about 20 wt. %, about 30 wt. %, about 32 wt. %, about 34 wt. %, about 36 wt. %, about 38 wt. %, about 40 wt. %, or any range including and/or in between any two of these values.

The lipid feedstock contains fatty acid-bound glycerol (or bound glycerol for short) in the form of glycerides (sum of monoglycerides, diglycerides, and triglycerides). The lipid feedstock may contain up to 90 wt. % glycerides. The glycerides content of lipid feedstock may be about 20 wt. %, about 30 wt. %, about 40 wt. %, about 50 wt. %, about 60 wt. %, about 70 wt. %, or about 90 wt. %, or between any two values within this range. For example, the lipid feedstock may contain a glycerides content in the range of 20 wt. % to 90 wt. %, or in the range of 30 wt. % to 80 wt. %.

The lipid feedstock may contain up to about 1000 wppm total chlorine. The total chlorine content of the lipid may be about 1 wppm, 2 wppm, 3 wppm, 4 wppm, 5 wppm, 6 wppm, 7 wppm, 8 wppm, 9 wppm, 10 wppm, 20 wppm, 30 wppm, 40 wppm, 50 wppm, 60 wppm, 70 wppm, 80 wppm, 90 wppm, 100 wppm, 110 wppm, 120 wppm, 130 wppm, 140 wppm, 150 wppm, 160 wppm, 170 wppm, 180 wppm, 190 wppm, 200 wppm, 300 wppm, 400 wppm, 500 wppm, 600 wppm, 700 wppm, 800 wppm, 900 wppm, 1000 wppm, or any range including and/or in between any two of these values. The lipid feedstock may also contain up to about 200 wppm WIS chlorine. The WIS chlorine content of the lipid may be about 1 wppm, 2 wppm, 3 wppm, 4 wppm, wppm, 6 wppm, 7 wppm, 8 wppm, 9 wppm, 10 wppm, 20 wppm, 30 wppm, 40 wppm, 50 wppm, 60 wppm, 70 wppm, 80 wppm, 90 wppm, 100 wppm, 110 wppm, 120 wppm, 130 wppm, 140 wppm, 150 wppm, 160 wppm, 170 wppm, 180 wppm, 190 wppm, 200 wppm, or any range including and/or in between any two of these values.

Thus, the lipid feedstock of any embodiment herein may include corn oil, distiller's corn oil, inedible corn oil, babassu oil, *carinata* oil, soybean oil, canola oil, coconut oil, rapeseed oil, tall oil, tall oil fatty acid, palm oil, palm oil fatty acid distillate, jatropha oil, palm kernel oil, sunflower oil, castor oil, camelina oil, archaeal oil, bacterial oil, fungal oil, protozoal oil, algal oil, seaweed oil, oils from halophiles, rendered fats, inedible tallow, edible tallow, technical tallow, floatation tallow, lard, poultry fat, poultry oils, fish fat, fish oils, frying oils, yellow grease, brown grease, waste vegetable oils, restaurant greases, trap grease from municipalities such as water treatment facilities, and spent oils from industrial packaged food operations, or a mixture or combination of any two or more thereof.

It has surprisingly been observed that the reaction of a chlorine-containing lipid feedstock with water at a temperature of approximately 500° F. for 15 to 360 minutes results in a reduction of the chlorine content of the lipid feedstock by up to 99%. Furthermore, it has surprisingly been observed that the reaction conditions can be controlled such that the reaction of a chlorine-containing lipid feedstock with water results in a greater extent of chlorine removal that that of removal of bound glycerol. In terms of glyceride conversion, the rate of WIS chlorine removed from the lipid exceeds the rate of glyceride conversion therein, allowing for optimizing the reaction to achieve the desired balance of WIS chlorine removal and bound glycerol content in the product.

The conversion of glycerides (sum of mono-, di-, and triglycerides, representing the bound glycerol compounds in the lipid) is less than 90%. In embodiments, the glyceride conversion is less than 85%. In embodiments, the glyceride conversion is less than 80%. For example, the glyceride conversion may be about 75%, about 70%, about 65%, about 60%, about 55%, about 50%, about 45%, or about 40%, or between any two of these values. For example, the glyceride conversion is between 40% and 90%, or between 45% and 85%.

The chlorine-diminished product according to the present technology contains a glycerides content (sum of mono-, di-, and triglycerides, representing the bound glycerol compounds in the lipid) of at least about 8 wt. %. In embodiments, the product contains about 10 wt. %, about 12 wt. %, about 14. wt. %, about 16 wt. %, about 18 wt. %, about 20 wt. %, about 22 wt. %, about 24 wt. %, about 26 wt. %, about 28 wt. %, about 30 wt. %, about 32 wt. %, about 34 wt. %, about 36 wt. %, about 38 wt. %, about 40 wt. %, about 42 wt. %, about 44 wt. %, about 46 wt. %, about 48 wt. %, or about 50 wt. % glycerides. In products that contains a glycerides content between any two values in this range. The chlorine-diminished product may thus contain between about 10 wt. % and 50 wt. % glycerides or between 20 wt. % and 40 wt. % glycerides.

Figure 3:
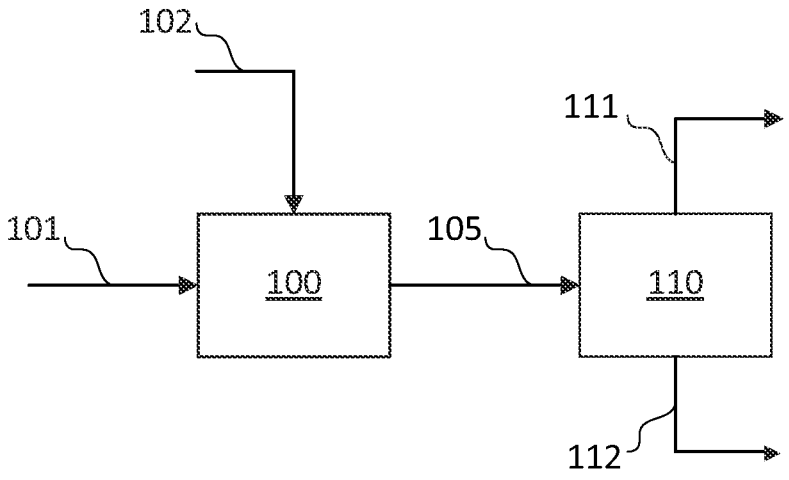
FIG. 3 is a block flow diagram showing an embodiment of the method of the invention.

Other aspects of the methods are described more generally with reference to FIG. 3. FIG. 3 is a schematic of one embodiment of the invention where a lipid feedstock stream 101 is contacted with a water stream 102 and reacted in a reactor system 100. In some embodiments, the water stream 102 may be liquid water, steam or any combination thereof. In some embodiments, the lipid feedstock stream 101 may undergo a pretreatment step prior to entering reactor 100. The pretreatment step could include one of water washing, acidulation (e.g., phosphoric acid, citric acid, etc.), caustic neutralization (e.g., sodium hydroxide, potassium hydroxide, etc.), adsorbent filtration (e.g., silica hydrogel, bleaching clay, ion exchange resins, etc.), absorbent filtration (e.g., diatomaceous earth, cellulose, etc.), FFA stripping, degumming (e.g., water degumming, acid degumming, etc.), or any combination of two or more of these steps.

Regardless of pretreatment method, the feedstock 101 has a WIS chlorine content between 5 wppm and 200 wppm. In some embodiments, the feedstock 101 has a WIS chlorine content between 10 wppm and 100 wppm.

Reactor 100 is operated at a temperature between 450 and 500° F. for 15 to 360 minutes. The reactor system 100 may be operated in batch or continuous mode. In some embodiments, reactor 100 can be a continuous stirred tank reactor (CSTR), a stirred batch reactor, a co-current liquid-liquid contactor, a counter-current liquid-liquid contactor, a static mixer, high shear inline mixer or other liquid reactor known to those skilled in the art. Batch reactor embodiments include provisions for heating and agitation. Heating may be provided by steam or heat transfer fluid (hot oil) circulation through reactor jacket or a heating coil, while agitation is provided through mechanical agitator, sparging of steam, and/or pump around circulation. Continuous reactors include a single CSTR or a plurality of CSTRs in series such that volume of the tank(s) provide the 15-360 minute residence time required for conversion. Other continuous reactor embodiments include counter-current water-contact columns (with provisions for steam injection) or tubular reactors with steam-jacketed piping networks were a turbulent flow of lipid/water is maintained at the desired temperature range for at least 15 minutes. In embodiments, the reactor system includes one or more of these reactors. Regardless of reactor type, the system is maintained at a pressure high enough to ensure water remains in liquid phase. Typical pressures for the reactor system 100 are in the 500-1200 psig range.

At these conditions, between 40 and 90% of the glycerides in feedstock 101 are converted. Following reactor 100, a mixed effluent, 105, is directed to separator 110 to separate a phase with a density less than water (i.e., light phase), 111, and a phase with a density greater than or equal to water (i.e., heavy phase), 112. In embodiments, light phase, 111, is a lipid stream including primarily glycerides and fatty acids while the heavy phase, 112, is an aqueous stream having primarily water, glycerol, metal ions, and salts. In embodiments, light phase, 111, has a chlorine content less than 50 wt. %, 55 wt. %, 60 wt. %, 65 wt. %, 70 wt. %, 75 wt. %, 80 wt. %, 85 wt. %, 90 wt. %, 95 wt. %, or 99 wt. % than the starting chlorine content of stream 101, or any range including and/or in between any two of these values. In some embodiments, light phase, 111, has a WIS chlorine content 50 wt. %, 55 wt. %, 60 wt %, 65 wt. %, 70 wt. %, 75 wt. %, 80 wt. %, 85 wt. %, 90 wt. %, 95 wt. %, or 99 wt. % less than the starting WS chlorine content of stream 101, or any range including and/or in between any two of these values.

Depending on the WIS chlorine content of the feedstock 101, the light phase 111 has a WIS chlorine content between 0.2 and 10 wppm. In preferred embodiments, the WIS chlorine content is less than 5 wppm.

Figure 4A:
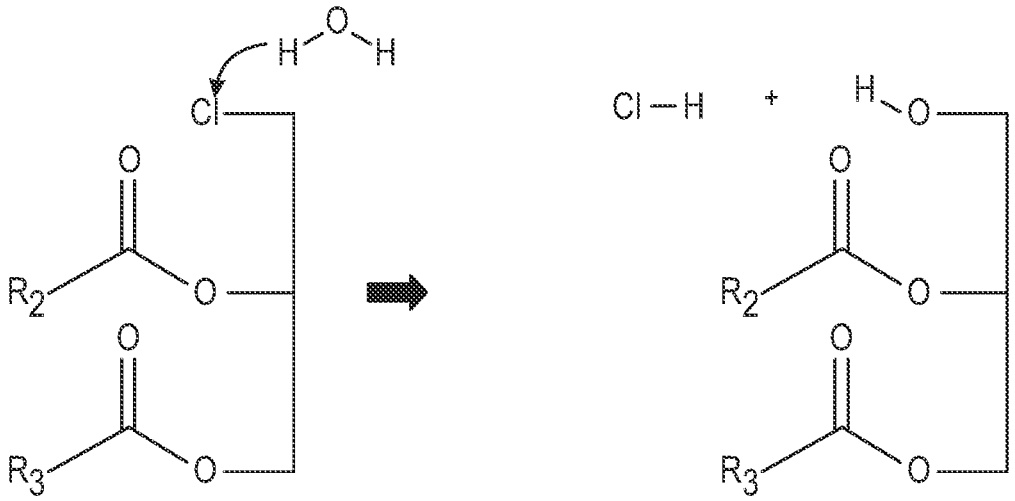
FIGS. 4A and 4B show a reaction scheme of the hydrolysis of water-insoluble fatty acid esters of monochloropropanediols (MCPD) to produce water-soluble hydrochloric acid and fatty-acid esters of glycerol.
Figure 4B:
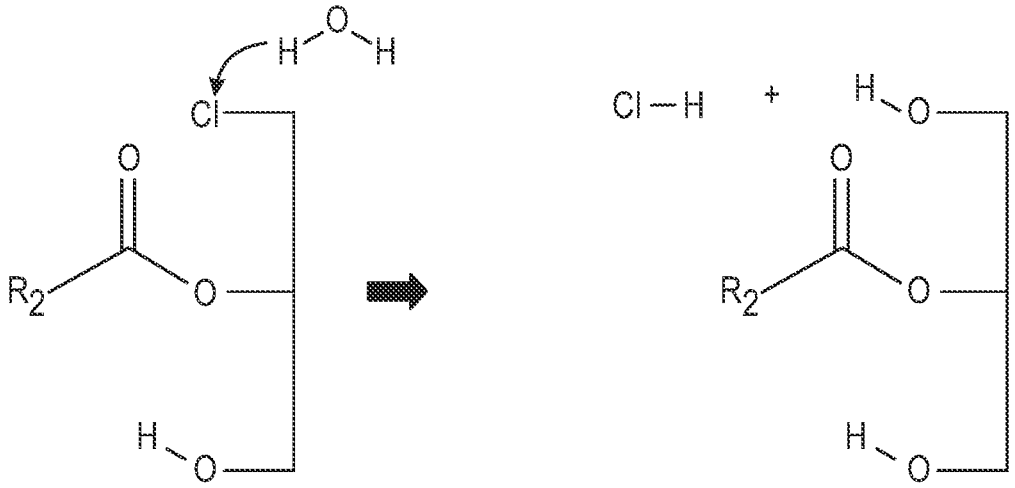
Figure 5A:
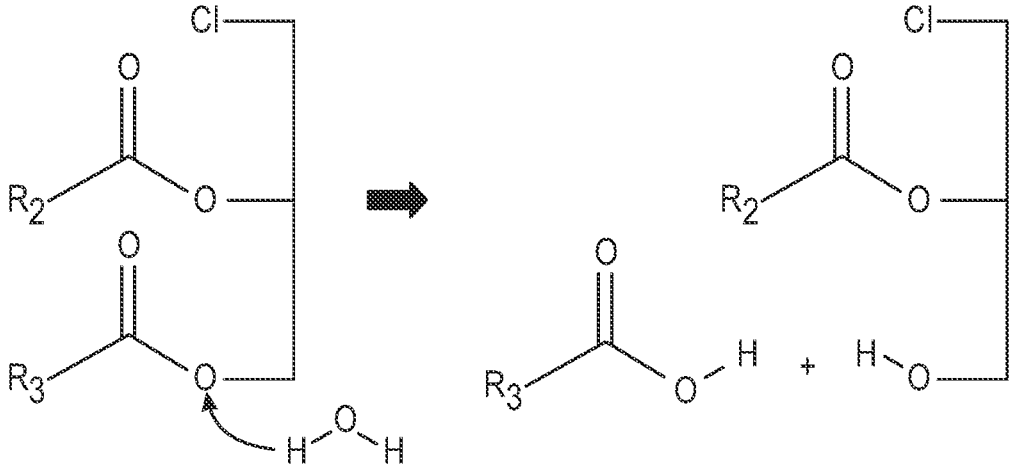
FIGS. 5A and 5B show a reaction scheme of a stepwise reaction for hydrolysis of water-insoluble fatty acid esters of monochloropropanediols (MCPD) to produce free fatty acid (FFA) and water-soluble MCPD.
Figure 5B:
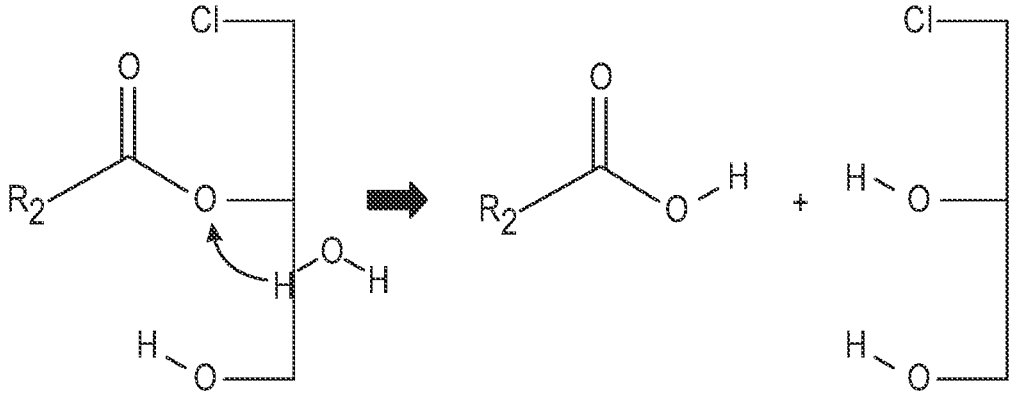
Figure 6A:
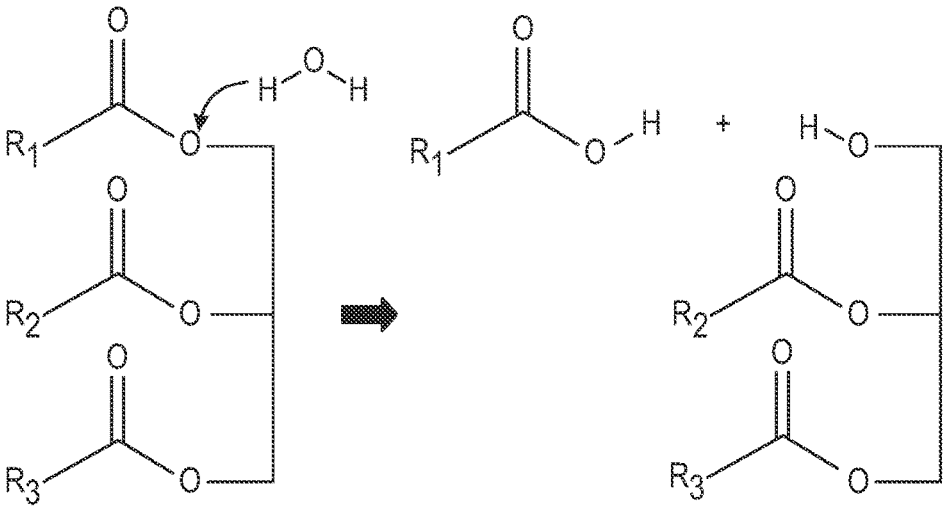
FIGS. 6A, 6B, and 6C show a reaction scheme of the reaction network for hydrolysis of fatty acid glyceride esters to produce free fatty acid (FFA) and glycerol.
Figure 6B:
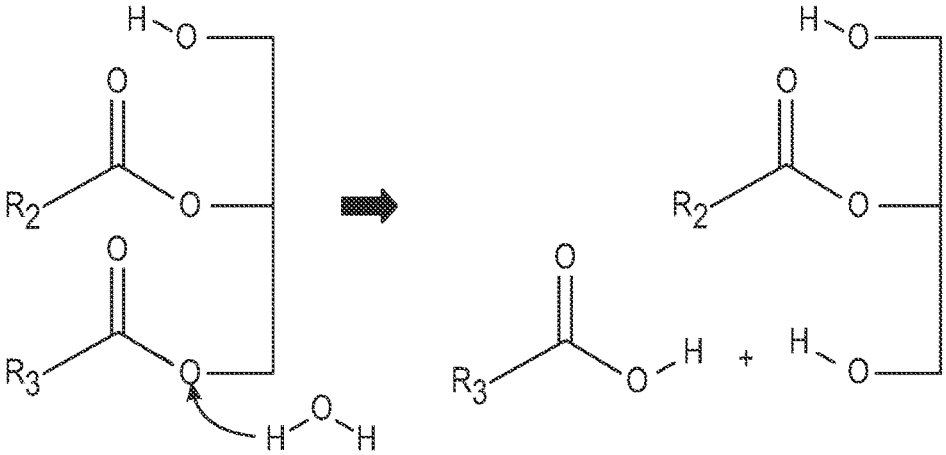
Figure 6C:
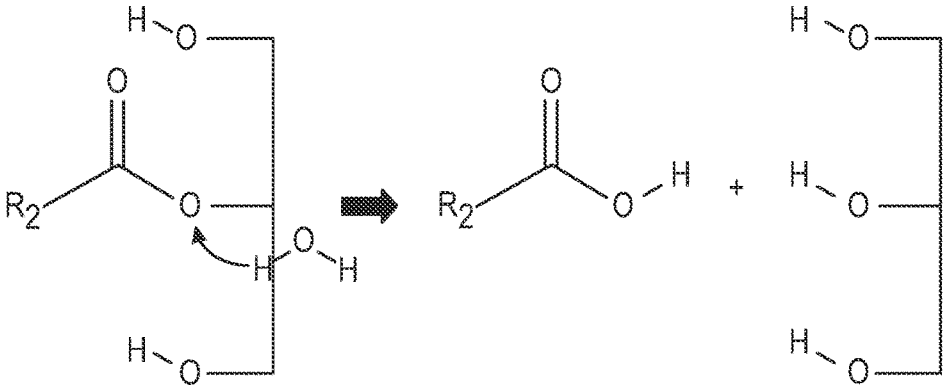

Without being bound to theory, reduction in the WIS chlorine content of lipids can be achieved through two primary pathways. The first is hydrolysis of the chlorine moiety directly from the glycerol backbone of fatty acid esters of MCPDs to produce WS hydrochloric acid and fatty acid glyceride esters as shown in FIGS. 4A and 4B. FIGS. 4A and 4B shows the hydrolysis of water-insoluble fatty acid esters of monochloropropanediols (MCPD) to produce water-soluble hydrochloric acid and fatty-acid esters of glycerol. One of either reaction 4A or reaction 4B may take place. The position of the chlorine moiety may vary such that the chlorine may also be positioned on a terminal carbon rather than the internal carbon, as shown. The second is hydrolysis of the WIS fatty acid moieties of fatty acid mono- and di-esters of MCPDs to produce free fatty acids (FFA) and MCPD as shown in FIGS. 5A and 5B. FIGS. 5A and 5B show a stepwise reaction for hydrolysis of water-insoluble fatty acid esters of monochloropropanediols (MCPD) to produce free fatty acid (FFA) and water-soluble MCPD. The reaction may also take place in a different order such that fatty acid R2 is removed in step 5A and fatty acid R3 is removed in step 5B. The position of the chlorine moiety may vary such that the chlorine may also be positioned on the internal carbon rather than the external carbon, as shown. Hydrolysis of fatty acid glyceride esters to produce FFA and glycerol, following the reaction scheme shown in FIGS. 6A, 6B and 6C, is a competing series of reactions that can occur simultaneously with the reaction schemes shown in FIGS. 4A and 4B and FIGS. 5A and 5B. Reactions 4A and 4B, as shown in FIGS. 4A and 4B, are the preferred pathway for reducing the WIS chlorine content of lipids because these reactions produce neither FFA, free glycerol, nor MCPD. The reactions shown in FIGS. 6A, 6B and 6C may take place in different orders such that the fatty acids (Rx) may be removed in any order in steps 6A, 6B and 6C.

FFA is undesirable as a feedstock for the production of renewable hydrocarbons due to a variety of reasons including metallurgical impacts, catalyst attrition, and the reduction in yield of renewable propane from hydrotreating glycerol. Similarly, free glycerol and MCPD have poor solubility in hydrocarbons and are therefore undesirable as feedstocks for HDO reactors that generally rely on hydrocarbon dilution for effective operation. Given these limitations, effective conversion of glycerol to propane in renewable hydrocarbon conversion units reactors requires the glycerol to remain bound to fatty acids as glycerides.

It has surprisingly been observed that the reaction in reactor 100 can be controlled to favor the dechlorination reaction such that the decrease in total moles of bound glycerin (in the form of mono-, di-, and triglycerides) is less than the decrease in total moles of chlorine in light phase 111.

In embodiments, an acid or acidic solution is dosed into reactor 100 to reduce the pH of the contents of reactor 100 to less than 6, less than 5, less than 4, less than 3, less than 2, less than 1, or any range including and/or in between any two of these values.

In embodiments, separator 110 can be a decanter, a stacked disk centrifuge, a horizontal centrifuge, a settling tank, a 3-phase separator, or other means of liquid-liquid separation known to those skilled in the art. In embodiments, reactor 100 and separator 110 can be the same processing unit.

In embodiments, a heat exchanger or other means of temperature reduction known to those skilled in the art is placed between reactor 100 and separator 110 to reduce the temperature of stream 105 to assist in separation of stream 111 and 112.

In some embodiments, increasing the residence time in reactor 100 can be used to control the extent of chlorine removal. This may be achieved by controlling the level in a CSTR, the cycle time in a batch reactor, or the flow rates through liquid-liquid contactor reactors.

In some embodiments, the light phase 111 has monoglyceride, diglycerides, triglycerides, and free fatty acids. In some embodiments, the glyceride content of light phase 111 is greater than 20 wt % and the WIS chlorine content is less than 5 wppm.

The present technology, thus generally described, will be understood more readily by reference to the following examples, which are provided by way of illustration and are not intended to be limiting of the present technology.

EXAMPLES

Example 1. Reduction of WIS Chlorine, Impurities in Used Cooking Oil Using Non-Catalyzed Hydrolysis Reaction Used cooking oil samples, obtained from various commercial restaurants in the U.S., were combined, and subjected to a pretreatment process prior to hydrolysis reaction. The UCO pretreatment process consisted of the following steps: acidulation, shear mixing, neutralization, centrifugal separation, filtration and drying. UCO was placed in a beaker and stirred on a hot plate maintained at 80° C., and metered out of the beaker continuously at 44 mL/min using a gear pump (Cole-Parmer 75211-10 Micropump). This oil was then combined with aqueous citric acid (9.89% wt in deionized water) metered at 1.38 mL/min using a piston pump (Eldex Optos 2HM). The UCO and aqueous citric acid were mixed in a beaker placed on a hot plate to maintain the liquid temperature at 60° C. Mixing was provided by a high shear mixer (Silverson L5M-A) operating at 1800 RPM. The liquid level in the beaker was set to achieve a mean residence time of approximately 22 minutes. A second gear pump was used to meter flow out of the beaker to maintain a constant level. The UCO aqueous citric acid mixture was contacted with aqueous sodium hydroxide (0.98% wt in deionized water) metered at 1.24 mL/min using a peristaltic pump (Ismatec 78017-07) to produce a neutralized composition. The neutralized UCO was pumped to a continuous centrifuge separator (CINC V-02) maintained at a temperature of 60° C. and operating at 5700 RPM. The heavy phase weir was adjusted to minimize water in the light phase. The light phase from the centrifuge was then filtered batch-wise in a pressurized 1 L filter assembly (Millipore YT30 142 HW) at a flowrate of 50 mL/min using a syringe pump (Teledyne 260D). The filter feed oil was pumped out of a flask on a stirred hot plate maintaining the liquid temperature at 60° C. The filter contained the following layers in order starting at the bottom: a screen support and metal screen, filter paper (Whatman cellulose Grade 5), diatomaceous earth, and silica hydrogel (W.R. Grace Trisyl 300). When the differential pressure reached 80 PSI the pump was stopped, and nitrogen was used to purge out the filtered oil. As a final treatment step, the filtered oil was dried using a vacuum flask on a stirred hot plate maintaining the liquid at approximately 95° C. and a vacuum pump was used to maintain a pressure of approximately 25 in Hg. Removed moisture was collected in a cold trap. The UCO properties after pretreatment are shown in Table 2.

A batch hydrolysis reaction was then carried out in a 1 L 316 stainless steel stirred reactor (Autoclave Engineers EZE-Seal reactor system) using 405.36 g of deionized water and 376.84 g of the treated used cooking oil. The water was first placed in the reactor, which was then sealed and pressurized with nitrogen to approximately 800 PSIG. This pressure was selected to be sufficiently above the minimum pressure needed to maintain the water as a liquid at the reaction temperature of 260° C. The magnetic drive mixer was set to approximately 1300 RPM, and the 1200 W electric heater was set to maintain an internal liquid temperature of 260° C. Once the water was heated up to the desired reaction temperature (260° C.), the accumulated pressure due to heating was vented to bring the reactor internal pressure back to approximately 800 PSIG. The pretreated UCO was poured into a separate, isolated 316 stainless steel feed cylinder (500 mL) maintained at approximately 60° C. by way of electric heat tape. The feed cylinder was pressurized with nitrogen to a higher pressure than the 1 L reactor (approximately 1000 PSIG), and then charged into the reactor by opening a valve that is connected to a dip tube terminating inside the reactor pointed toward the mixer element. After the feed was charged into the reactor, the reactor pressure was approximately 1000 PSIG and a timer was started to indicate the beginning of the reaction. The reaction temperature dropped momentarily to approximately 248° C. (indicating feed was successfully charged into the reactor), but was quickly heated back to the set point temperature. Liquid samples were taken from the reactor periodically by opening a needle valve connected to a dip tube extending into the reactor, which initiates flow out of the reactor due to the pressure differential from the reactor conditions to atmospheric pressure. The sample tube flows through the inner tube of a tube-in-tube heat exchanger, where the larger diameter outer tube has counter-current flowing domestic water flowing through it. As the sampling procedure reduces the internal pressure in the reactor, a nitrogen supply valve was periodically opened to allow flow into the reactor to maintain approximately 1000 PSIG.

Reactor samples were collected at 3, 7, 11, 16, 30, 45, 360 minutes after the pretreated UCO was charged into the reactor. All samples pulled from the reactor were subsequently washed with deionized water (approximately 5 mL of deionized water added to 20 mL of sample) and separated in a lab centrifuge (Ample Scientific, Champion F-33D) operating at for 2800 RPM for 3 minutes. The centrifuge light phase was pipetted off and considered the water insoluble (WIS) reaction product. This product was subjected to additional analysis according to the methods as shown in Table 3 for the following sampling times (in minutes): 3, 7, 11, 16, 30, 45, and 360. The 360 minute sample was representative of the final reaction product after completing the experiment.

TABLE 2

Pretreated Used Cooking Oil Properties

| Property | Method | Unit | Value |
|---|---|---|---|
| KF moisture | ASTM D4377 | % wt | 0.21 |
| FFA | AOCS Ca 5a-40 | % wt | 10.99 |
| Arsenic | Modified ASTM D7691 | ppm | n.d. |
| Calcium | Modified ASTM D7691 | ppm | 0.45 |
| Chromium | Modified ASTM D7691 | ppm | n.d. |
| Cobalt | Modified ASTM D7691 | ppm | n.d. |
| Copper | Modified ASTM D7691 | ppm | 0.27 |
| Iron | Modified ASTM D7691 | ppm | 0.19 |
| Lead | Modified ASTM D7691 | ppm | 0.16 |
| Lithium | Modified ASTM D7691 | ppm | n.d. |
| Magnesium | Modified ASTM D7691 | ppm | 0.19 |
| Manganese | Modified ASTM D7691 | ppm | n.d. |
| Molybdenum | Modified ASTM D7691 | ppm | n.d. |
| Nickel | Modified ASTM D7691 | ppm | n.d. |
| Phosphorous | Modified ASTM D7691 | ppm | 2.02 |
| Potassium | Modified ASTM D7691 | ppm | 1.75 |
| Silicon | Modified ASTM D7691 | ppm | 0.71 |
| Sodium | Modified ASTM D7691 | ppm | 6.21 |
| Strontium | Modified ASTM D7691 | ppm | 0.20 |
| Vanadium | Modified ASTM D7691 | ppm | n.d. |
| Zinc | Modified ASTM D7691 | ppm | 0.19 |
| Chlorine | Modified ASTM D4929 | ppm | 22.85 |
| Steryl Esters | REG Method | % wt | 1.92 |
| Free Sterols | REG Method | % wt | 0.09 |
| Free Glycerin | Modified ASTM D6584 | % wt | 0.00 |
| Ethyl Esters | REG Method | % wt | 0.01 |
| Methyl Esters | REG Method | % wt | 0.00 |
| Monoglycerides | Modified ASTM D6584 | % wt | 0.43 |
| Triglycerides | Modified ASTM D6584 | % wt | 60.10 |
| Total Glycerin | Modified ASTM D6584 | % wt | 7.80 |
| Diglycerides | Modified ASTM D6584 | % wt | 9.48 |
| Total glycerides | | % wt | 70.01 |

Note:
n.d.—Not Detected

TABLE 3

Hydrolyzed used cooking oil properties as a function of reaction time

| | | | Value at various reaction times (min) | | | | | | |
|---|---|---|---|---|---|---|---|---|---|
| Property | Method | Unit | 3 | 7 | 11 | 16 | 30 | 45 | 360 |
| FFA | AOCS Ca 5a-40 | % wt | 5.28 | 13.08 | 23.87 | 35.11 | 57.27 | 71.75 | 86.22 |
| Arsenic | Modified ASTM D7691 | ppm | n.d. | n.t. | n.d. | n.d. | n.d. | n.d. | n.d. |
| Calcium | Modified ASTM D7691 | ppm | 0.25 | n.t. | 0.76 | 0.50 | 0.58 | 0.29 | 0.99 |
| Chromium | Modified ASTM D7691 | ppm | 0.21 | n.t. | 0.37 | 0.27 | 0.75 | 1.44 | 9.96 |
| Cobalt | Modified ASTM D7691 | ppm | n.d. | n.t. | n.d. | n.d. | n.d. | n.d. | 0.14 |
| Copper | Modified ASTM D7691 | ppm | 0.18 | n.t. | 0.27 | 0.20 | 0.20 | 0.21 | 0.28 |
| Iron | Modified ASTM D7691 | ppm | 3.23 | n.t. | 20.22 | 12.65 | 16.66 | 30.76 | 428.82 |
| Lead | Modified ASTM D7691 | ppm | 0.45 | n.t. | 0.32 | n.d. | n.d. | n.d. | 0.52 |

TABLE 3-continued

Hydrolyzed used cooking oil properties as a function of reaction time

| Property | Method | Unit | Value at various reaction times (min) | | | | | | |
|---|---|---|---|---|---|---|---|---|---|
| | | | 3 | 7 | 11 | 16 | 30 | 45 | 360 |
| Lithium | Modified ASTM D7691 | ppm | n.d. | n.t. | n.d. | n.d. | n.d. | n.d. | n.d. |
| Magnesium | Modified ASTM D7691 | ppm | 0.13 | n.t. | 0.16 | 0.15 | 0.15 | 0.14 | 0.15 |
| Manganese | Modified ASTM D7691 | ppm | n.d. | n.t. | n.d. | n.d. | n.d. | n.d. | 10.65 |
| Molybdenum | Modified ASTM D7691 | ppm | 3.50 | n.t. | 2.67 | 1.13 | 0.76 | 0.62 | 0.86 |
| Nickel | Modified ASTM D7691 | ppm | 0.65 | n.t. | 1.82 | 0.96 | 0.63 | 0.70 | 9.46 |
| Phosphorous | Modified ASTM D7691 | ppm | 3.33 | n.t. | 2.61 | 1.13 | 0.93 | 0.98 | 0.50 |
| Potassium | Modified ASTM D7691 | ppm | 0.22 | n.t. | 0.37 | 0.26 | 0.23 | 0.20 | 0.24 |
| Silicon | Modified ASTM D7691 | ppm | 1.04 | n.t. | 0.77 | 0.53 | 0.39 | 0.55 | 0.42 |
| Sodium | Modified ASTM D7691 | ppm | n.d. | n.t. | 0.34 | n.d. | n.d. | n.d. | n.d. |
| Strontium | Modified ASTM D7691 | ppm | 0.17 | n.t. | 0.20 | 0.18 | 0.17 | 0.16 | 0.16 |
| Vanadium | Modified ASTM D7691 | ppm | n.d. | n.t. | n.d. | n.d. | n.d. | n.d. | n.d. |
| Zinc | Modified ASTM D7691 | ppm | 0.15 | n.t. | 0.16 | 0.14 | n.d. | n.d. | 0.75 |
| WIS Chlorine | Modified ASTM D4929 | ppm | 8.08 | 12.27 | 9.93 | 5.25 | 2.71 | 1.72 | 0.24 |
| Monoglycerides | Modified ASTM D6584 | % wt | 0.31 | 1.15 | 3.60 | 7.14 | 8.69 | 7.12 | 1.76 |
| Triglycerides | Modified ASTM D6584 | % wt | 19.74 | 40.13 | 34.65 | 22.67 | 7.89 | 2.73 | 0.65 |
| Diglycerides | Modified ASTM D6584 | % wt | 4.45 | 11.80 | 19.10 | 22.12 | 14.25 | 8.56 | 4.30 |
| Total glycerides | | % wt | 24.5 | 53.1 | 57.3 | 51.9 | 30.8 | 18.4 | 6.71 |
| Glyceride conversion | | % | 65.0 | 24.2 | 18.1 | 25.8 | 56.0 | 73.7 | 90.4 |

Notes:
n.d.—Not Detected
n.t.—Not Tested

As shown in Table 3, the WIS chlorine reduction relative to the pretreated UCO (Table 2) was 46% reduction within 7 minutes (12.27 PPM), and 98.9% reduction by the end of the reaction (0.24 PPM).

Upon further analysis of the data presented in Table 3 it was surprisingly observed that the reduction in bound glycerol occurred at a rate considerably slower than the reduction of WIS chlorine. The moles of chlorine were calculated from the concentration data shown in Table 3 by multiplying the concentration by the total mass of sample and then dividing by the molar mass of chlorine, 35.45 g/mol. Similarly, the moles of bound glycerol were calculated by multiplying each concentration of monoglycerides, diglycerides, and triglycerides shown in Table 3 by the sample mass and then dividing by the molar masses of mono-olein (356.54 g/mol), di-olein (620.99 g/mol), and tri-olein (885.43 g/mol), respectively. Each mole of mono-, di-, and triglycerides represents one mole of bound glycerol.

Figure 7:
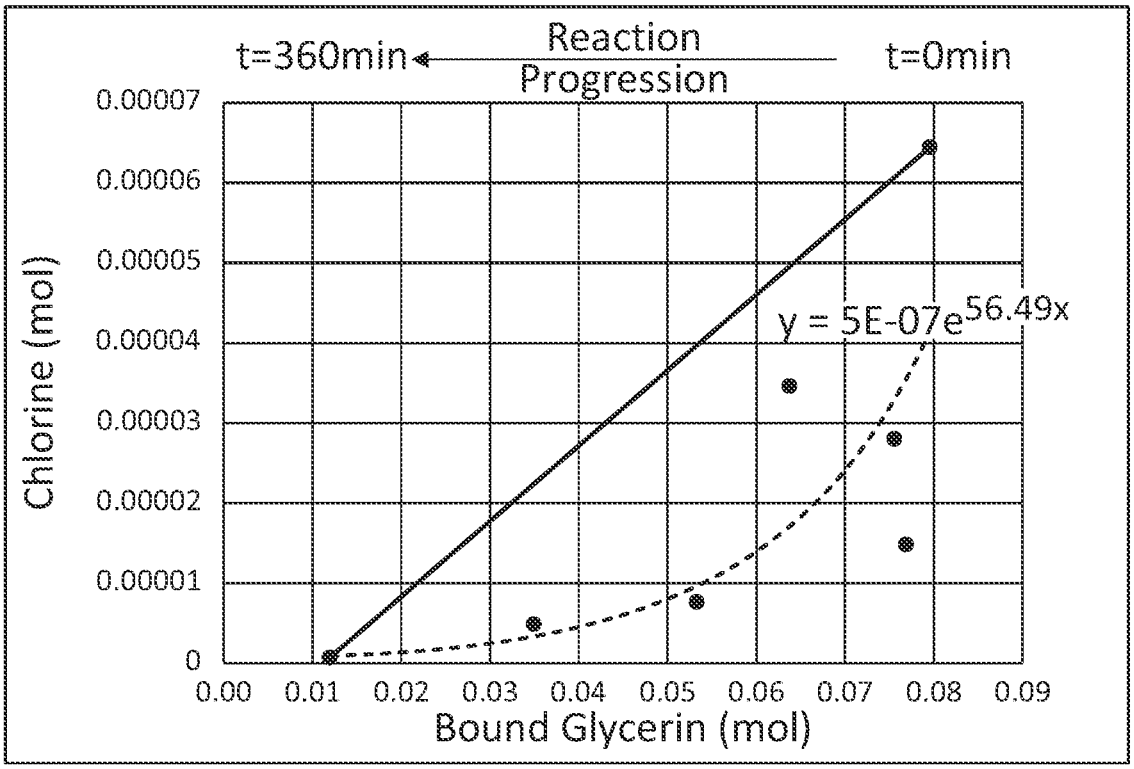
FIG. 7 is a graph showing the experimental results comparing the concentration of chlorine to the concentration of bound glycerol through the hydrolysis reaction. The solid line represents a linearly proportional change in chlorine and bound glycerol while the circles and curved-dashed line represent the experimental data generated in Example 1.

FIG. 7 depicts the total moles of chlorine (y-axis) versus the total moles of bound glycerin (x-axis) as the reaction progressed. The solid, linear line represents the hypothetical change in WIS chlorine if it was hydrolyzed proportionally to that of bound glycerol, whereas the curved-dashed line represents the actual change in chlorine versus that of bound glycerol as measured for this experiment. Without being bound to theory, if the reduction in chlorine followed the reaction network shown in FIGS. 5A and 5B, the actual results should fall either on or above the solid line, indicating that WIS chlorine is removed as MCPD, along with free glycerol, through complete hydrolysis of glyceride esters. However, because the curved-dashed line, representing actual experiment results, is below the solid theoretical line, the data surprisingly suggests that the direct hydrolysis of chlorine from MCPDs, as shown in FIGS. 4A and 4B, is the dominant reaction. Thus, full (i.e., near-theoretical) hydrolysis is not needed to achieve meaningful dechlorination of lipids. For example, an 88% reduction in the moles of WIS chlorine was achieved while only 33% of the bound glycerin had been removed.

Another metric for the relative selectivity of chlorine removal vs. glycerol liberation is conversion of total glyceride. Starting with the total glycerides content of 70% (sum of mono-, di-, and triglycerides in Table 2), the results of this example summarized in Table 3 show that WIS chlorine level of 2.71 ppm were reached (an 88% reduction in WIS chlorine) with only 56% conversion of glycerides (see 30 minute reaction time results in Table 3).

Example 2. Reduction of WIS Chlorine in Used Cooking Oil Using Non-Catalyzed Hydrolysis Reaction In this example, the same pretreated UCO as in Example 1 was subjected to the same conditions as Example 1, but with modified sampling frequency to produce the results shown in Table 4.

TABLE 4

Hydrolyzed used cooking oil properties as a function of reaction time

| Property | Method | Unit | Value at various reaction times (min) | | | | | |
|---|---|---|---|---|---|---|---|---|
| | | | 5 | 15 | 30 | 45 | 60 | 300 |
| FFA | AOCS Ca 5a-40 | % wt | 24.93 | 30.25 | 51.40 | 74.92 | 80.72 | 81.23 |
| Chlorine | Modified ASTM D4929 | ppm | 13.85 | 13.66 | 4.45 | 1.53 | 1.32 | 0.33 |

As shown in Table 4, the results were similar to those shown in Table 3 of Example 1. In this example, the WIS chlorine was reduced by 39.4% (13.66 PPM) after 15 minutes, and after 300 minutes, the chlorine was reduced by 98.6% (0.33 PPM).

Example 3. Reduction of WIS Chlorine in Used Cooking Oil Using Acid-Catalyzed Hydrolysis Reaction A batch hydrolysis reaction was carried out in a 1 L 316 stainless steel stirred reactor (Parr Instrument Company, 4525 bench top reactor system) using 316.75 g of deionized water, 268.6 g of the pretreated UCO described in Example 1 and Table 1, and 10.93 g of sulfuric acid (95% wt in water). The water, pretreated UCO, and sulfuric acid were added to the reactor which was then sealed. The ⅛ hp magnetic drive mixer was turned on to approximately 25%, and the 1000 W electric heater that is part of the Parr 4525 reactor system was set to maintain an internal temperature of 204° C. The internal temperature was maintained at the 204° C. set point by an external temperature control unit (Parr Instrument Company, 4848 Reactor Controller). No cooling water was used for temperature control. The reaction pressure was the equilibrium pressure of the reactor contents at 204° C., which would be expected to be approximately 230-235 PSIG. The reaction mixture took approximately 1 hour to reach the desired reaction temperature of 204° C., at which point the first sample was obtained. A ½" OD sample tube (316 stainless steel) with a volume of approximately 20 mL was assembled with a needle valve on both ends. The bottom needle valve was open to the atmosphere, and the top needle valve was connected with ¼" tubing to a dip tube on the reactor; the dip tube terminated near the bottom of the reactor. The sample tube was placed in an insulated open top container with domestic water to cool the sample prior to handling. When the top needle valve was opened the pressure differential between the reactor and the sample tube (at atmospheric pressure) would cause reactor material to flow into the sample tube. After a moment to allow for cooling, the sample tube was removed from the water bath, and the bottom needle valve was opened slowly to depressurize the sample tube and collect the sample. The collected samples were subsequently washed with deionized water (approximately 5 mL of deionized water added to 20 mL of sample) and separated in a lab centrifuge (Ample Scientific, Champion F-33D) operating at for 2800 RPM for 3 minutes. The light phase oil after the centrifuge step was pipetted off and considered the water insoluble (WIS) reaction product. This product was subjected to additional analysis according to the methods as shown in Table 5 for the following sampling times (in hours): 1, 2, 3, 4, 5, 6. The 6 hour sample was representative of the end of the reaction.

TABLE 5

Acid hydrolyzed used cooking oil properties as a function of reaction time

| Property | Method | Unit | Value at various reaction times (hr) | | | | | |
|---|---|---|---|---|---|---|---|---|
| | | | 1 | 2 | 3 | 4 | 5 | 6 |
| FFA | AOCS Ca 5a-40 | % wt | 53.18 | 77.38 | 84.71 | 85.91 | 86.10 | 85.50 |
| Arsenic | Modified ASTM D7691 | ppm | n.d. | n.d. | n.d. | n.d. | n.d. | n.d. |
| Calcium | Modified ASTM D7691 | ppm | 1.65 | 2.292 | n.d. | n.d. | n.d. | n.d. |
| Chromium | Modified ASTM D7691 | ppm | 1265 | 6200 | 14284 | 18073 | 18137 | 7013 |
| Cobalt | Modified ASTM D7691 | ppm | 0.172 | 0.269 | 0.469 | 0.606 | 0.547 | 0.29 |
| Copper | Modified ASTM D7691 | ppm | 0.625 | 1.843 | 3.394 | 6.747 | 9.909 | 7.175 |
| Iron | Modified ASTM D7691 | ppm | 13.57 | 28.02 | 27.44 | 21.71 | 16.86 | 8.76 |
| Lead | Modified ASTM D7691 | ppm | 0.135 | n.d. | n.d. | n.d. | n.d. | n.d. |
| Lithium | Modified ASTM D7691 | ppm | 0.192 | 0.324 | 0.292 | 0.414 | 0.288 | 0.178 |
| Magnesium | Modified ASTM D7691 | ppm | 0.475 | 1.187 | 0.93 | 0.909 | 0.964 | 0.494 |
| Manganese | Modified ASTM D7691 | ppm | 0.159 | n.d. | n.d. | n.d. | n.d. | n.d. |
| Molybdenum | Modified ASTM D7691 | ppm | 55.28 | 297 | 723.7 | 898.3 | 931.3 | 374.3 |
| Nickel | Modified ASTM D7691 | ppm | 1.068 | 1.706 | 1.029 | 1.156 | 1.076 | 0.742 |
| Phosphorous | Modified ASTM D7691 | ppm | n.d. | n.d. | 1.677 | 2.969 | 4.499 | 2.908 |
| Potassium | Modified ASTM D7691 | ppm | 5.37 | 2.329 | 0.247 | 0.902 | 0.222 | 0.221 |
| Silicon | Modified ASTM D7691 | ppm | 3.233 | 10.4 | 11.22 | 11.06 | 11.06 | 3.893 |
| Sodium | Modified ASTM D7691 | ppm | 6.846 | 10.94 | 7.524 | 7.782 | 6.403 | 1.827 |
| Strontium | Modified ASTM D7691 | ppm | 0.431 | 0.865 | 0.744 | 0.78 | 0.687 | 0.323 |
| Vanadium | Modified ASTM D7691 | ppm | 0.609 | 0.511 | 4.971 | 10.18 | 13.33 | 9.497 |
| Zinc | Modified ASTM D7691 | ppm | n.d. | n.d. | n.d. | n.d. | n.d. | n.d. |
| Chlorine | Modified ASTM D4929 | ppm | 11.27 | 5.9 | 4.23 | 3.87 | 4.7 | 3.76 |

Notes:
n.d.—Not Detected

As shown in Table 5, the final WIS chlorine value was 3.76 PPM which is a 83.5% reduction from the initial value (22.85 PPM as shown in Table 2).

Example 4. Reduction of WIS Chlorine in Used Cooking Oil Using Non-Catalyzed Hydrolysis Reaction A batch hydrolysis reaction was carried out in the 1 L 316 stainless steel stirred reactor as described in Example 3 using 330.55 g of deionized water and 278.43 g of the pretreated UCO described in Example 1. The water and pretreated UCO were added to the reactor, which was then sealed up. The ⅛ hp magnetic drive mixer was turned on to approximately 25%, and the 1000 W electric heater that is part of the Parr 4525 reactor system was set to 260° C. (based on internal temperature measurement). The internal temperature was maintained at the 260° C. set point by an external temperature control unit (Parr Instrument Company, 4848 Reactor Controller). No cooling water was used for temperature control. The reaction pressure was the equilibrium pressure of the reactor contents at 260° C., which would be expected to be approximately 650 PSIG. The reaction mixture took slightly longer to reach the set point compared to Example 3, however the first sample was still obtained after 1 hour of reaction at which point the temperature was approximately 235° C. The sampling and water washing procedure for the samples in this example were the same as described in Example 3. The samples from this example were subjected to additional analysis according to the methods as shown in Table 6 for the following sampling times (in hours): 1, 2, 3, 6 and 7.

TABLE 6

Hydrolyzed used cooking oil properties as a function of reaction time

| Property | Method | Unit | Value at various reaction times (hr) 1 | 2 | 3 | 6 | 7 |
|---|---|---|---|---|---|---|---|
| FFA | AOCS Ca 5a-40 | % wt | 24.27 | 86.64 | 90.89 | 90.96 | 90.32 |
| Arsenic | Modified ASTM D7691 | ppm | n.d. | n.d. | n.d. | n.d. | n.d. |
| Calcium | Modified ASTM D7691 | ppm | 0.284 | 0.511 | 0.767 | 0.74 | 0.704 |
| Chromium | Modified ASTM D7691 | ppm | 146.1 | 26.14 | 26.37 | 29.42 | 30.69 |
| Cobalt | Modified ASTM D7691 | ppm | n.d. | 0.272 | 0.47 | 0.795 | 0.892 |
| Copper | Modified ASTM D7691 | ppm | 1.156 | 3.174 | 4.734 | 4.653 | 4.547 |
| Iron | Modified ASTM D7691 | ppm | 28.39 | 88.3 | 108.9 | 196.4 | 224.5 |
| Lead | Modified ASTM D7691 | ppm | n.d. | 0.233 | 0.244 | 0.331 | 0.344 |
| Lithium | Modified ASTM D7691 | ppm | n.d. | n.d. | n.d. | n.d. | n.d. |
| Magnesium | Modified ASTM D7691 | ppm | 0.198 | 0.176 | 0.18 | 0.191 | 0.2 |
| Manganese | Modified ASTM D7691 | ppm | n.d. | 0.569 | 1.66 | 3.221 | 3.738 |
| Molybdenum | Modified ASTM D7691 | ppm | 6.753 | 2.534 | 2.819 | 3.725 | 4.307 |
| Nickel | Modified ASTM D7691 | ppm | 0.889 | 8.583 | 15.01 | 25.67 | 29.16 |
| Phosphorous | Modified ASTM D7691 | ppm | 0.588 | 0.878 | 0.817 | 0.752 | 0.823 |
| Potassium | Modified ASTM D7691 | ppm | 1.449 | 0.844 | 0.572 | 0.416 | 0.354 |
| Silicon | Modified ASTM D7691 | ppm | 0.77 | 0.659 | 0.673 | 0.736 | 0.773 |
| Sodium | Modified ASTM D7691 | ppm | 1.631 | 0.488 | n.d. | n.d. | n.d |
| Strontium | Modified ASTM D7691 | ppm | 0.23 | 0.192 | 0.189 | 0.188 | 0.188 |
| Vanadium | Modified ASTM D7691 | ppm | n.d | 0.122 | 0.132 | 0.147 | 0.15 |
| Zinc | Modified ASTM D7691 | ppm | 0.15 | 0.557 | 0.896 | 1.129 | 1.186 |
| Chlorine | Modified ASTM D4929 | ppm | 9.63 | 0.96 | 0.10 | 0.12 | 0.41 |

Notes:
n.d.—Not Detected

Compared to Table 5 of Example 3, wherein the hydrolysis reaction was catalyzed with sulfuric acid and carried out at a lower temperature of 204° C., Table 6 indicates improved WIS chlorine reduction. After 1 hour, the WIS chlorine was reduced by 57.9% (9.63 PPM) and after 3 hours it was reduced by 99.6% (0.10 PPM).

It will thus be seen according to the present invention a highly advantageous method for the removal of contaminants from fats, oils, and greases has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

What is claimed is:

1. A method for reducing the chlorine content of a lipid feedstock, comprising the steps of:

feeding a lipid feedstock with a chlorine content greater than 5 wppm and a free fatty acid content of about 5-40 wt. % to a hydrolysis reactor;

contacting the lipid feedstock with a water stream and an acid catalyst;

mixing the lipid feedstock and the water stream with the acid catalyst at a temperature between 450 and 550° F. to produce a mixed effluent; and separating the mixed effluent into a chlorine-diminished light phase and a chlorine-enriched heavy phase;

wherein the chlorine-diminished light phase has a decrease in the moles of bound glycerol that is less than 50% of the decrease in moles of chlorine.

2. The method of claim 1, wherein the acid catalyst is sulfuric acid.

3. The method of claim 1, wherein the chlorine content of the lipid feedstock is greater than 15 wppm.

4. The method of claim 1, wherein the chlorine content of the lipid feedstock is greater than 20 wppm.

5. The method of claim 1, wherein the chlorine-diminished light phase has a chlorine content less than 60% of the chlorine content of the lipid feedstock.

6. The method of claim 1, wherein the chlorine-diminished light phase has a chlorine content less than 50% of the chlorine content of the lipid feedstock.

7. The method of claim 1, wherein the chlorine-diminished light phase has a chlorine content less than 20% of the chlorine content of the lipid feedstock.

8. The method of claim 1, wherein the chlorine content is water-insoluble chlorine.

9. The method of claim 1, further comprising subjecting the chlorine-diminished light phase to a hydroprocessing process to produce renewable hydrocarbons.

10. The method of claim 1, wherein the chlorine-diminished light phase has a total glycerides content (sum of mono-, di-, and triglycerides) that is at least 18 wt. %.

11. A method for removal of water insoluble (WIS) chlorine from a lipid feedstock comprising the steps of:

feeding the lipid feedstock to a hydrolysis reactor, wherein the lipid feedstock contains about 5-40 wt. % free fatty acid;

contacting the lipid feedstock with a water stream and an acid catalyst at a temperature between 450 and 550° F. to produce a mixed effluent; and separating the mixed effluent into a chlorine-diminished light phase and a chlorine-enriched heavy phase;

wherein, the lipid feedstock has a total glycerides content of less than 90 wt. % and a WIS chlorine content greater than 10 wppm, the reactor is operated to convert less than 70% of the glycerides, and the chlorine-diminished light phase has a WIS chlorine content of less than 5 wppm.

12. The method of claim 11, wherein the chlorine-diminished light phase has a glycerides content greater than 18 wt. %.

13. A method for reducing the chlorine content of a lipid feedstock, comprising the steps of:

feeding a lipid feedstock with a chlorine content greater than 5 wppm and a free fatty acid content of about 5-40 wt. % to a hydrolysis reactor;

contacting the lipid feedstock with a water stream and an acid catalyst;

mixing the lipid feedstock, the water stream, and the acid catalyst at a temperature between 450 and 550° F. to produce a mixed effluent;

separating the mixed effluent into a chlorine-diminished light phase and a chlorine-enriched heavy phase; and subjecting the chlorine-diminished light phase to a hydroprocessing process to produce renewable hydrocarbons;

wherein the chlorine-diminished light phase has a decrease in the moles of bound glycerol that is less than 50% of the decrease in moles of chlorine.

14. The method of claim 13 wherein, the lipid feedstock has a total glycerides content of less than 90 wt. % and a WIS chlorine content greater than 10 wppm, the reactor is operated to convert less than 70% of the glycerides, and the chlorine-diminished light phase has a WIS chlorine content of less than 5 wppm.

15. The method of claim 13, wherein the chlorine content of the lipid feedstock is greater than 10 wppm.

16. The method of claim 13, wherein the chlorine content of the lipid feedstock is greater than 15 wppm.

17. The method of claim 13, wherein the chlorine-diminished light phase has a chlorine content less than 60% of the chlorine content of the lipid feedstock.

18. The method of claim 13, wherein the chlorine-diminished light phase has a chlorine content less than 50% of the chlorine content of the lipid feedstock.

* * * * *